US011648644B2

(12) United States Patent
Lee et al.

(10) Patent No.: US 11,648,644 B2
(45) Date of Patent: May 16, 2023

(54) POLISHING PAD CONDITIONING APPARATUS

(71) Applicant: SAMSUNG ELECTRONICS CO., LTD., Suwon-si (KR)

(72) Inventors: Eun Seok Lee, Hwaseong-si (KR); Ja Eung Koo, Yongin-si (KR); Kuen Byul Kim, Suwon-si (KR); Jeong Min Na, Seoul (KR); Chang Gil Ryu, Yongin-si (KR); Hyeon Dong Song, Suwon-si (KR); Young Seok Jang, Suwon-si (KR); Jin Suk Hong, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 967 days.

(21) Appl. No.: 16/517,849

(22) Filed: Jul. 22, 2019

(65) Prior Publication Data

US 2020/0206870 A1 Jul. 2, 2020

(30) Foreign Application Priority Data

Jan. 2, 2019 (KR) ..... 10-2019-0000251

(51) Int. Cl.
*B24B 53/017* (2012.01)
*B24B 57/02* (2006.01)
(Continued)

(52) U.S. Cl.
CPC ..... *B24B 53/017* (2013.01); *B24B 37/34* (2013.01); *B24B 53/12* (2013.01); *B24B 57/02* (2013.01);
(Continued)

(58) Field of Classification Search
CPC ..... B24B 53/017; B24B 53/12; B24B 37/34; B24B 13/145; B24B 21/18
(Continued)

(56) References Cited

U.S. PATENT DOCUMENTS 6,123,607 A * 9/2000 Ravkin ..... B24B 53/003 451/72
6,149,512 A 11/2000 Wilson et al.
(Continued)

FOREIGN PATENT DOCUMENTS

KR 10-2008-0033368 A 4/2008
WO 2007008822 A2 1/2007

OTHER PUBLICATIONS

Dr. Layton Carter Hale "Principles and Techniques for Designing Precision Machines" Massachusetts Institute of Technology, Feb. 1999, (pp. 1-493).

*Primary Examiner* — Joseph J Hail
*Assistant Examiner* — Shantese L McDonald
(74) *Attorney, Agent, or Firm* — Sughrue Mion, PLLC

(57) ABSTRACT

A polishing pad conditioning apparatus according to an example embodiment of the present inventive concept includes an apparatus body, a pivot arm provided on the apparatus body and including a housing having an internal space and provided at a distal end portion of the pivot arm and a head unit disposed at the distal end portion of the pivot arm. The head unit includes: a rotary motor provided in the internal space of the housing, the rotary motor including a rotary shaft; a foreign material blocking member connected to the rotary shaft; a disk holder connected to the rotary shaft; and a conditioning disk coupled to the disk holder. The foreign material blocking member includes a fluid flow groove configured to guide a movement of fluid for pre-
(Continued)

venting foreign objects from entering the housing on an outer surface of the foreign material blocking member.

17 Claims, 6 Drawing Sheets

(51) Int. Cl.

| | |
|---|---|
| ***B24D 13/14*** | (2006.01) |
| ***B24B 53/12*** | (2006.01) |
| ***B24B 37/34*** | (2012.01) |
| *B24B 37/10* | (2012.01) |
| *B24B 21/18* | (2006.01) |

(52) U.S. Cl.
CPC ..... *B24D 13/145* (2013.01); *B24B 21/18* (2013.01); *B24B 37/105* (2013.01)

(58) Field of Classification Search
USPC ..... 451/56, 285, 443
See application file for complete search history.

(56) References Cited

U.S. PATENT DOCUMENTS

| | | | | |
|---|---|---|---|---|
| 6,394,886 | B1 | 5/2002 | Chen et al. | |
| 6,887,138 | B2 | 5/2005 | Bottema et al. | |
| 6,893,331 | B2 | 5/2005 | Huang et al. | |
| 6,969,307 | B2 | 11/2005 | Kiermasz | |
| 7,963,826 | B2 * | 6/2011 | Nangoy | B24B 53/005 451/443 |
| 8,550,879 | B2 | 10/2013 | Chen et al. | |
| 8,662,956 | B2 * | 3/2014 | Seo | B24B 53/017 451/21 |
| 2003/0013394 | A1 | 1/2003 | Choi et al. | |
| 2004/0259487 | A1 * | 12/2004 | Bottema | B24B 53/12 451/444 |
| 2005/0167048 | A1 * | 8/2005 | Polyak | B24B 53/017 257/E21.244 |
| 2007/0010172 | A1 | 1/2007 | Benner | |
| 2007/0087672 | A1 | 4/2007 | Benner | |
| 2007/0207705 | A1 | 9/2007 | Benner | |
| 2014/0315473 | A1 | 10/2014 | Chen et al. | |
| 2017/0008146 | A1 | 1/2017 | Diaz et al. | |
| 2019/0283215 | A1 * | 9/2019 | Lee | H01L 21/304 |

* cited by examiner

X-X'

POLISHING PAD CONDITIONING APPARATUS

CROSS-REFERENCE TO RELATED APPLICATION

This application claims priority under 35 U.S.C. § 119 to Korean Patent Application No. 10-2019-0000251 filed on Jan. 2, 2019 in the Korean Intellectual Property Office, the disclosure of which is incorporated herein by reference in its entirety.

BACKGROUND

1. Field

Apparatuses consistent with example embodiments relate to a polishing pad conditioning apparatus.

2. Description of the Related Art

In the manufacturing process of a semiconductor device, a chemical mechanical polishing (CMP) process using a CMP device may be used for planarizing (or level out) a wafer. A CMP device of the related art includes a polishing pad for polishing a surface of a wafer and a polishing pad conditioning apparatus including a diamond disk for conditioning a polishing surface of the polishing pad. However, in such a device, there may be the issue of foreign materials entering an outer housing of the device and advancing towards a rotary motor which drives the diamond disk to rotate for conditioning the polishing surface of the polishing pad. Also, the part of the device on which the diamond disk is installed may experience uneven pressure and break.

SUMMARY

One or more example embodiments may provide a polishing pad conditioning apparatus capable of preventing foreign materials from entering a housing of the apparatus and moving towards a rotary motor rotating a conditioning disk.

One or more example embodiments may also provide a polishing pad conditioning apparatus capable of reducing uneven wear of a conditioning disk and capable of reducing damage to a structure having the conditioning disk installed thereon.

According to an aspect of an example embodiment, there is provided a polishing pad conditioning apparatus including an apparatus body, a pivot arm provided on the apparatus body and including a housing having an internal space and provided at a distal end portion of the pivot arm and a head unit disposed at the distal end portion of the pivot arm. The head unit includes: a rotary motor provided in the internal space of the housing, the rotary motor including a rotary shaft; a foreign material blocking member connected to the rotary shaft; a disk holder connected to the rotary shaft; and a conditioning disk coupled to the disk holder. The foreign material blocking member includes a fluid flow groove configured to guide a movement of fluid for preventing foreign objects from entering the housing on an outer surface of the foreign material blocking member.

According to an aspect of another example embodiment, there is provided a polishing pad conditioning apparatus including an apparatus body, a pivot arm extending from the apparatus body and including a housing having an internal space and provided at a first end portion of the pivot arm, and a head unit disposed at the first end portion of the pivot arm. The head unit includes: a rotary motor provided in the internal space of the housing and comprising a rotary shaft, a deformation member connected to the rotary shaft of the rotary motor, a disk holder connected at a first portion of the deformation member along an axial direction of the deformation member, and a conditioning disk coupled to the disk holder. The deformation member includes a deformation groove for reducing deformation stress induced by an external force to the conditioning disk.

BRIEF DESCRIPTION OF DRAWINGS

The above and/or other aspects, features, and advantages of the disclosure will be more clearly understood from the following detailed description, taken in conjunction with the accompanying drawings, in which.

DETAILED DESCRIPTION

Hereinafter, example embodiments of the present inventive concept will be described with reference to the accompanying drawings.

Figure 1:
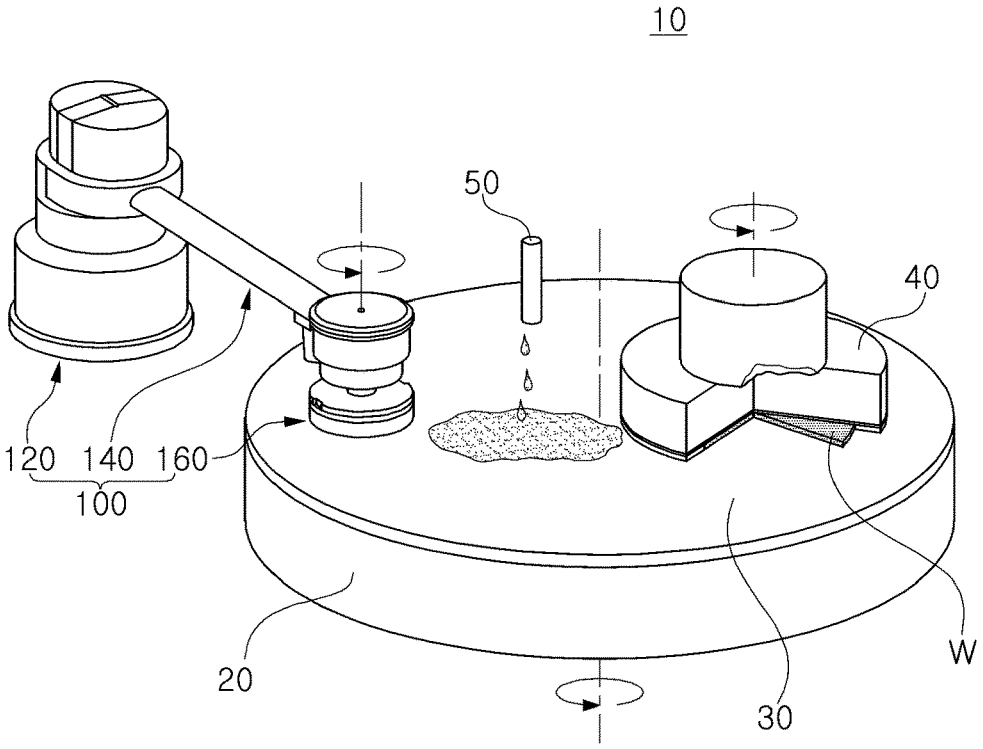
FIG. 1 illustrates a chemical mechanical polishing apparatus including a polishing pad conditioning apparatus according to an example embodiment.

FIG. 1 illustrates a chemical mechanical polishing apparatus 10 including a polishing pad conditioning apparatus 100 according to an example embodiment.

Referring to FIG. 1, a chemical mechanical polishing apparatus 10 may include, for example, a turntable 20, a wafer carrier 40, a slurry dispensing unit 50, and a polishing pad conditioning device 100.

The turntable 20 may be rotatably installed on a rotary shaft (not illustrated), and a top portion of the turntable 20 may have the shape of a circular flat plate. The turntable 20 may be rotated in a predetermined direction, for example, in a counter-clockwise direction or in a clockwise direction.

In addition, a polishing pad 30 may be installed on a top surface of the turntable 20, and the polishing pad 30 may be, for example, a hard polyurethane pad.

The wafer carrier 40 may have the shape of a circular plate with a smaller diameter than that of the polishing pad 30. A wafer W can be mounted on the wafer carrier 40. The wafer W mounted on the wafer carrier 40 may be rotated while touching the polishing pad 30. While a planarization process for the wafer W is in progress, CMP may be performed using slurry dispensed from the slurry dispensing unit 50. Further, the slurry dispensing unit 50 may be disposed so as to be able to dispense the slurry towards a center portion of the turntable 20 (or the polishing pad 30). Accordingly, the dispensed slurry may be evenly distributed onto the polishing pad 30 by the centrifugal force.

The polishing pad conditioning apparatus 100 may be an apparatus for conditioning a polishing surface of the polishing pad 30. The polishing pad conditioning apparatus 100 can keep the surface roughness of the polishing surface of the polishing pad 30 in an optimal condition by polishing the polishing surface. For example, the polishing pad conditioning apparatus 100 may control (i.e., to restore or to maintain) the surface roughness of the wafer W, by polishing the polishing pad 30 while the polishing pad 30 polishes the wafer W, or after polishing of the wafer W has stopped.

Figure 2:
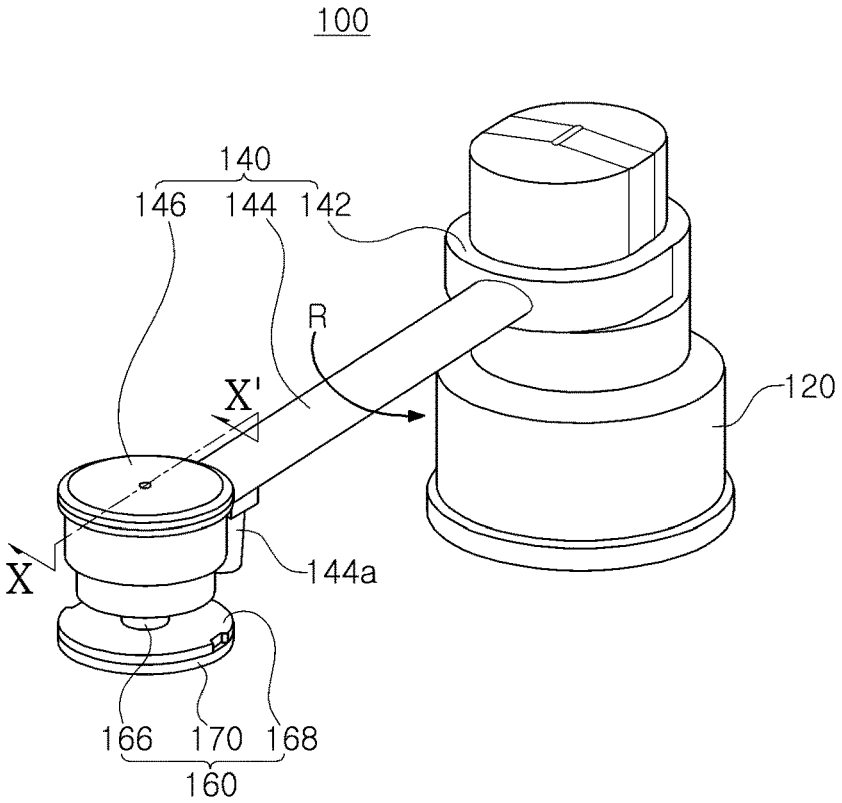
FIG. 2 illustrates a polishing pad conditioning apparatus according to an example embodiment.
Figure 3:
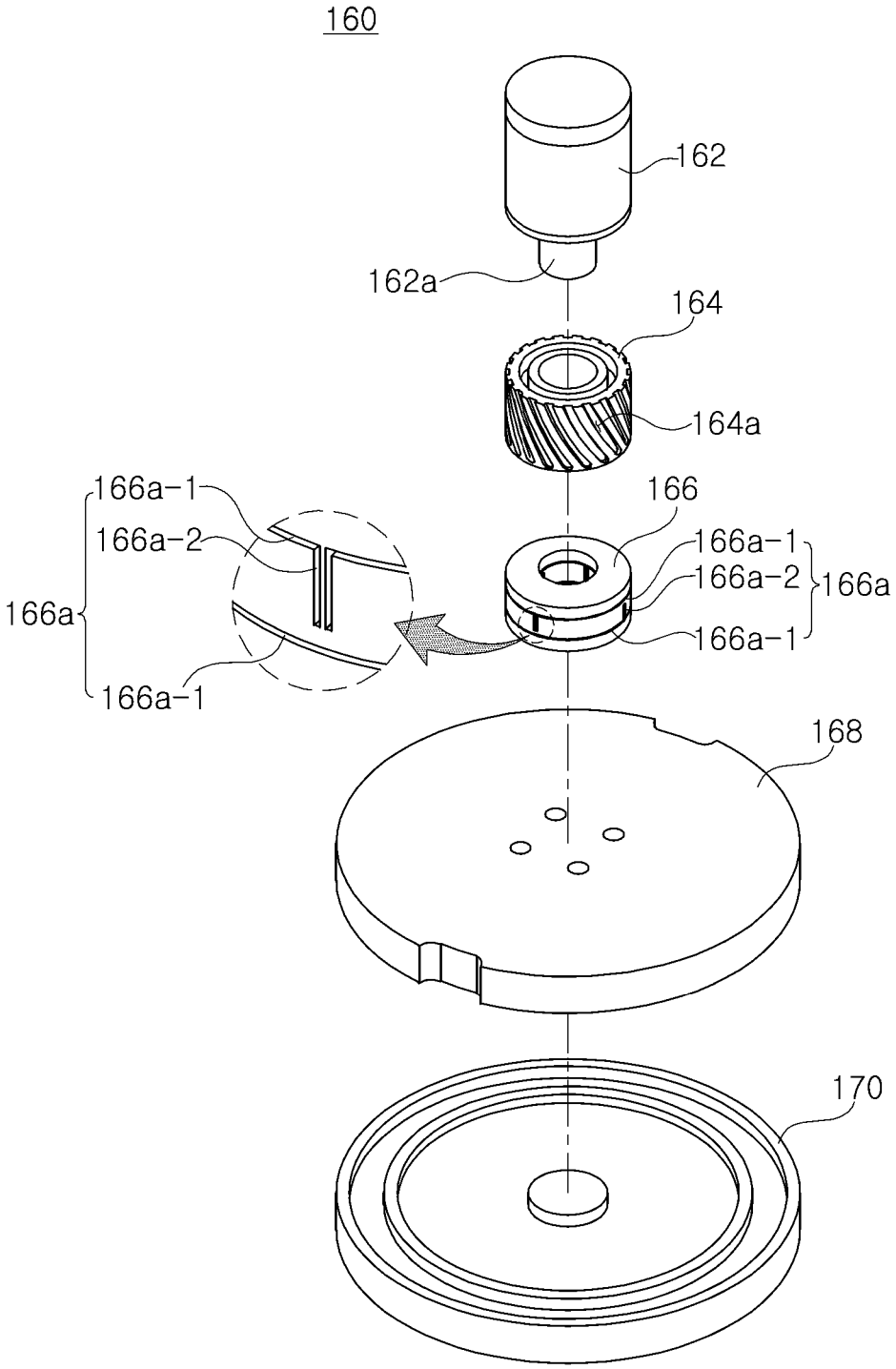
FIG. 3 illustrates an exploded perspective view of a head unit of a polishing pad conditioning apparatus including a fluid flow groove according to an example embodiment.
Figure 4:
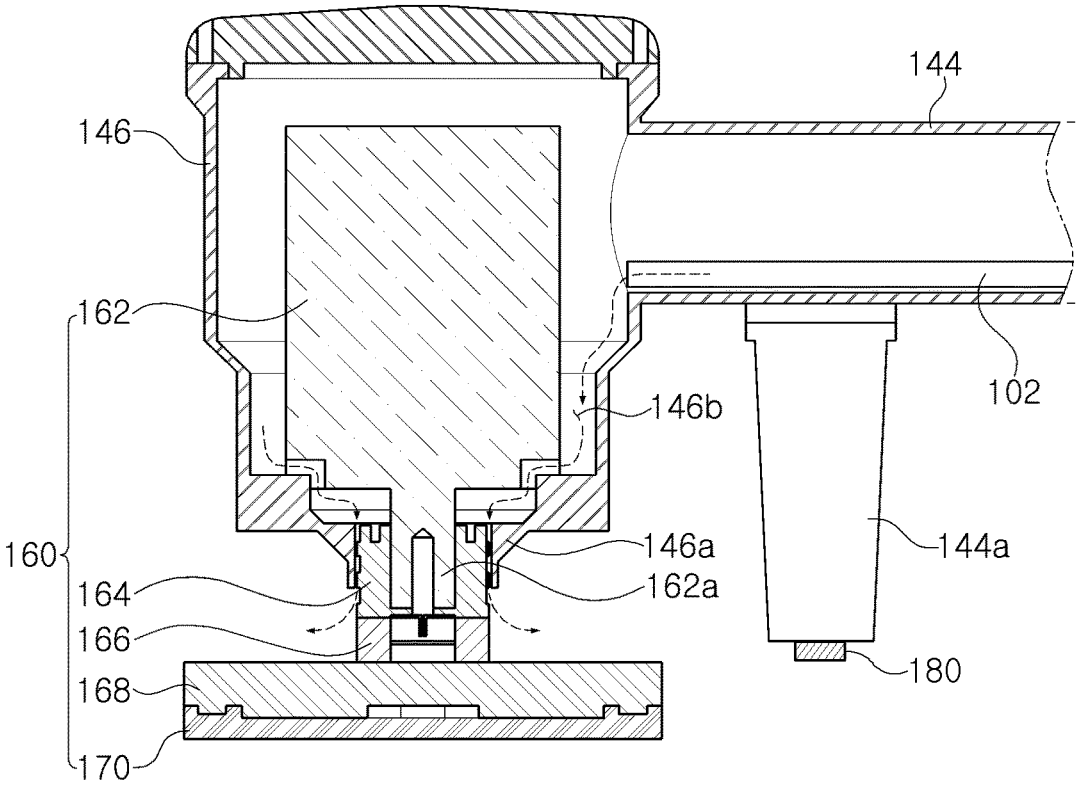
FIG. 4 illustrates a cross-sectional view taken along line X-X' of FIG. 2.

FIG. 2 illustrates a polishing pad conditioning apparatus 100 according to an example embodiment, FIG. 3 illustrates an exploded perspective view of a head unit 160 of a polishing pad conditioning apparatus 100 according to an example embodiment, and FIG. 4 is a cross-sectional view taken along line X-X' of FIG. 2 illustrating a head unit 160 and a pivot arm 140.

Referring to FIG. 2 to FIG. 4, the polishing pad conditioning apparatus 100 includes, for example, an apparatus body 120, a pivot arm 140, and a head unit 160.

The apparatus body 120 may be disposed in proximity to the turntable 20. The apparatus body 120 may be provided with a main motor (not illustrated) for rotating the pivot arm 140 in a circumferential direction R of the apparatus body 120. Further, the apparatus body 120 may be provided with an air cylinder (not illustrated) for moving the head unit 160 towards the polishing pad 30 provided on the turntable 20 or for moving the head unit 160 away from the polishing pad 30.

More specifically, by the main motor and the air cylinder provided on the apparatus body 120, the pivot arm 140 may be rotated in a circumferential direction of the apparatus body 120, thereby rotating about a pivot center of the apparatus body 120.

The pivot arm 140 may be installed on the apparatus body 120, and in particular, may be installed on the apparatus body 120 so as to be rotatable about the pivot center. For example, the pivot arm 140 may include a mounting part 142 mounted on the apparatus body 120, an arm part 144 extending from the mounting part 142 in a radial direction of the apparatus body 120, and a housing 146 disposed at a distal end portion of the arm part 144. In particular, the pivot center (not illustrated) may be disposed inside the mounting part 142. The pivot arm 140 may be formed of metal material.

Also, the arm part 144 may be provided with a sensor mounting part **144*a* in which a sensor 180 is installed. The sensor 180 installed in the sensor mounting part 144*a* may detect and assess the roughness of the polishing surface of the polishing pad 30. For example, the sensor mounting part 144*a* may be disposed in proximity to the housing 146. The arm part 144 may be formed as a hollow pipe, and a fluid flow tube 102 for guiding of fluid and various wires may pass through the inside of the arm part 144**.

Further, the housing 146 has an internal space. For example, a lower end portion of the housing 146 may be provided with a reduced diameter part **146*a* having a smaller diameter than that of an upper portion of the housing 146 as shown in FIG. 4. Also, the housing 146 may include a fluid flow path 146*b* through which the fluid flows to be discharged from the housing 146. In particular, the fluid supplied from the fluid flow tube 102 passing through the arm unit 144 may flow inside the fluid flow path 146*b*. In the example embodiment, the fluid flowing through the fluid flow path 146*b* may be air, an inert gas (for example, nitrogen gas, argon gas, etc.), or water. Also, the fluid flowing through the fluid flow path 146*b* may be discharged from the housing 146 through a space formed by an inner surface of the reduced diameter part 146*a* and an outer surface of a foreign material blocking member 164. Accordingly, foreign objects can be prevented from entering the reduced diameter part 146*a* of the housing 146** from the exterior thereof.

The head unit 160 may be disposed at the distal end portion of the pivot arm 140. For example, the head unit 160 may include a rotary motor 162 provided in the housing 146, the foreign material blocking member 164, a deformation member 166, a disk holder 168, and a conditioning disk 170.

The rotary motor 162 may be installed in the housing 146 so as to be disposed in the internal space of the housing 146 of the pivot arm 140. Further, the rotary motor 162 may be provided with a rotary shaft **162*a* to which the foreign material blocking member 164 is detachably attached. The rotary motor 162 serves to generate a rotational force for rotating the foreign material blocking member 164, the deformation member 166, and the conditioning disk 170 along with the disk holder 168**.

The foreign material blocking member 164 may be installed on the rotary shaft **162*a* of the rotary motor 162. In particular, the foreign material blocking member 164 may be disposed at the reduced diameter portion 146*a* of the housing 146. In addition, on the outer surface of the foreign material blocking member 164, the fluid flow groove 164*a* may be formed to guide the fluid in order to prevent foreign objects from entering through the reduced diameter portion 146*a* of the housing 146. For example, the fluid flow groove 164*a* may have a spiral shape or a curved shape, and these shape of the fluid flow groove 164*a* may be disposed facing towards a rotational direction of the foreign material blocking member 164. Accordingly, through the spiral-shaped fluid flow groove 164*a*, a fluid movement from the inside of the housing 146 to the exterior of the housing 146 may be created. Thus, foreign objects can be prevented from entering through the reduced diameter portion 146*a* of the housing 146 from the exterior thereof. For example, the (spiral-shaped or curved) fluid flow groove 164*a* may be formed to have a predetermined width w and depth d. For example, the (spiral-shaped or curved) fluid flow groove 164*a* may be formed to have a uniform width w and depth d. The example embodiments of the fluid flow groove 164*a*** will be described in more detail below.

Referring to FIG. 3, the deformation member 166 may be disposed between the foreign material blocking member 164 and the disk holder 168. For example, the deformation member 166 may be manufactured integrally with the foreign material blocking member 164 and the disk holder 168, or may be manufactured separately and then assembled with the foreign material blocking member 164 and the disk holder 168. Also, the deformation member 166 may include a deformation groove **166*a* for deformation of the deformation member 166 when an external force is applied to an outer surface thereof. For example, the deformation groove 166*a* may include a first deformation groove 166*a*-1 formed horizontally to the rotary shaft 162*a* and a second deformation groove 166*a*-2 disposed perpendicularly to the first deformation groove 166*a*-1**.

For example, the first deformation groove **166*a*-1 may be provided in plurality, and the plurality of first deformation grooves 166*a*-1 may be disposed in an axial direction and may be spaced apart from each other in a circumferential direction of the deformation member 166. The second deformation groove 166***a*-2 may extend from the first deformation grooves 166*a*-1, and a plurality of second deformation grooves 166*a*-2 may extend from a single first deformation groove 166*a*-1.

As described above, because the first and second deformation grooves 166*a*-1 and 166*a*-2 are formed in the deformation member 166, upon application of an external force, the deformation member 166 can be easily deformed with six degrees of freedom (three axial directions, and rotational directions around the three axial directions). To this end, the deformation member 166 may be made of an elastic material. For example, the deformation member 166 may be made of various materials, such as composite material, synthetic resin, and metal.

Accordingly, the deformation member 166 can reduce the uneven wear of the conditioning disk 170 and can further reduce damage to the disk holder 168. In other words, when an external force is applied to the deformation member 166, the deformation member 166 can reduce the shock or impact through deformation, and the conditioning disk 170 may be maintained to be perpendicularly in contact with the polishing pad 30.

Although in this example embodiment, the deformation groove 166 is described as including only the first and second deformation grooves 166*a*-1 and 166*a*-2, the deformation groove 166 may further include a third deformation groove (not shown) which is formed obliquely with respect to the first deformation groove 166*a*-1.

The disk holder 168 may be disposed below the deformation member 166 and may be connected to the rotary shaft 162*a* by means of the deformation member 166 and the foreign material blocking member 164. The disk holder 168 may have the shape of a circular plate. Also, the disk holder 168 may be formed of material with a larger weight than that of the deformation member 166.

The conditioning disk 170 may be affixed to the disk holder 168. Polishing particles, such as artificial diamond particles for example, may be evenly fixed onto a circular disk by means of a nickel (Ni) bonding layer.

As described above, the uneven wear of the conditioning disk 170 may be reduced through the deformation member 166. Further, damage to the disk holder 168 may be reduced through the deformation member 166.

A fluid movement from the inside of the housing 146 to the exterior thereof may be created through the foreign material blocking member 164, thereby preventing foreign objects from entering the housing 146 through the reduced diameter portion 146*a* of the housing 146. In other words, the fluid movement created through the fluid flow groove 164*a* formed on the outer surface of the foreign material blocking member 164 may serve to prevent the foreign objects from entering the housing 146.

Furthermore, by causing the fluid flowing through the fluid flow path 146*b* to be discharged from the housing 146, foreign objects can be further prevented from entering the housing 146 from the exterior thereof.

Hereinbelow, example embodiments of the fluid flow groove 164*a* of the foreign material blocking member 164 will be described in conjunction with drawings.

Figure 5:
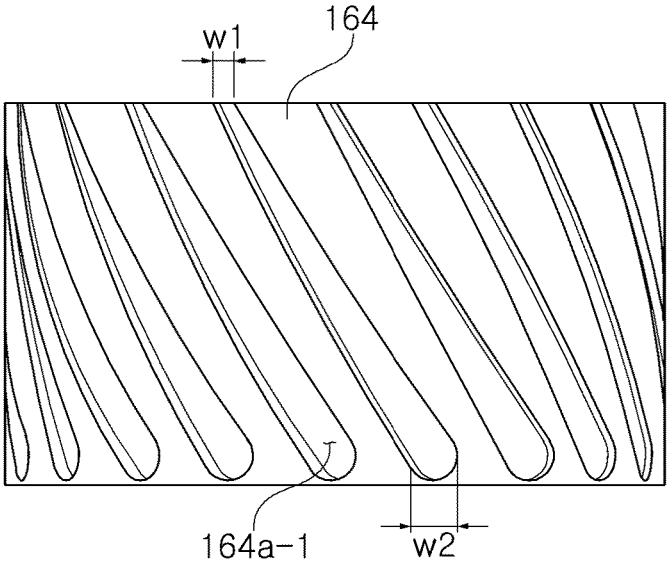
FIG. 5 illustrates an enlarged view of an example embodiments of a fluid flow groove.

FIG. 5 is an enlarged view illustrating an example embodiments of a fluid flow groove 164*a*-1.

Referring to FIG. 5, the fluid flow groove 164*a*-1 may have a spiral shape, and the spiral shape of the fluid flow groove 164*a*-1 may be disposed facing towards a rotational direction of the foreign material blocking member 164. Accordingly, the fluid movement of the fluid to the exterior of the housing 146 from the inside of the housing 146 may be created through the spiral-shaped fluid flow groove 164*a*-1. Thus, foreign materials can be prevented from entering the housing 146 from the exterior thereof. For example, the fluid flow groove 164*a*-1 may be formed to have width w1 at an upper end portion of the outer surface of the foreign material blocking member 164 being smaller than width w2 at a lower end portion of the outer surface of the foreign material blocking member 164. In other words, the width of the fluid flow groove 164*a*-1 may be formed to increase from the upper end portion to the lower end portion. Accordingly, the pressure at the upper end portion of the outer surface of the foreign material blocking member 164 may be greater than the pressure at the lower end portion of the outer surface of the foreign material blocking member 164. Consequently, in the foreign material blocking member 164, the fluid may flow from the upper end portion of greater pressure, towards the lower end portion of lesser pressure due to the pressure difference.

Figure 6:
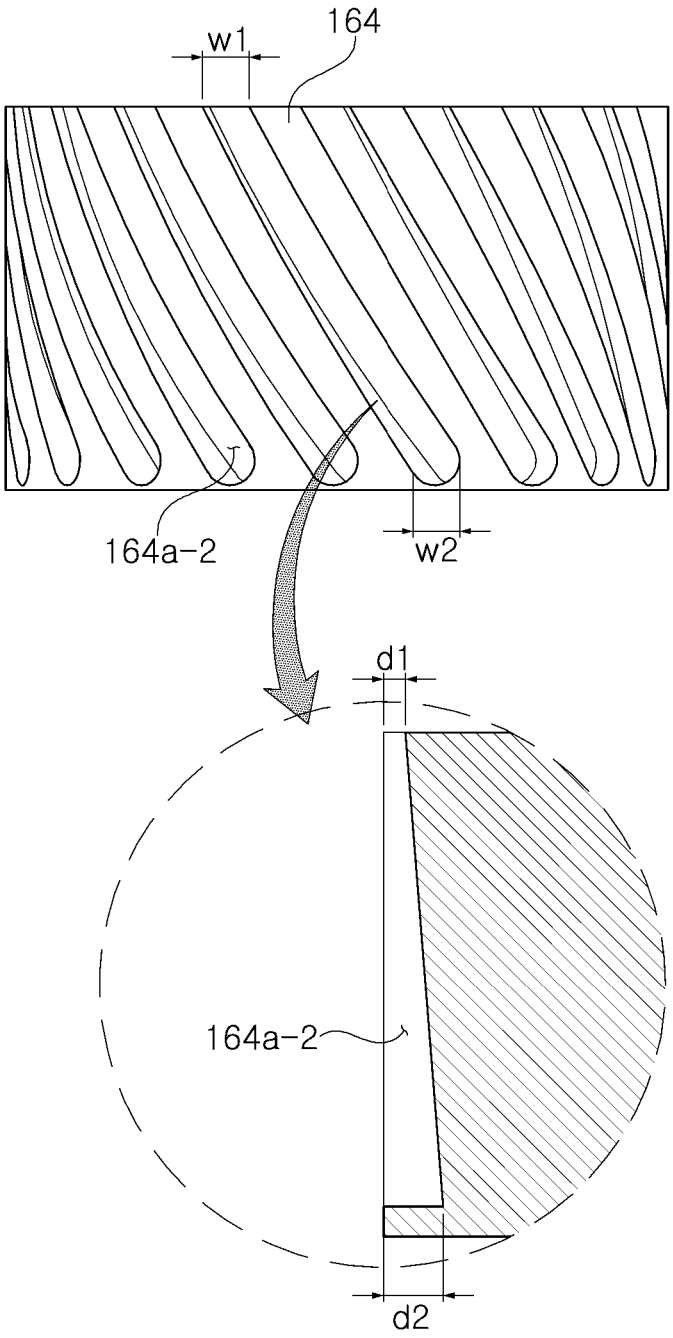
FIG. 6 illustrates an enlarged view of another example embodiment of a fluid flow groove.

FIG. 6 is an enlarged view of another one of the modified embodiments of the fluid flow groove.

Referring to FIG. 6, the fluid flow groove 164*a*-2 may have a spiral shape, and the spiral shape of the fluid flow groove 164*a*-2 may be disposed facing towards a rotational direction of the foreign material blocking member 164. The fluid movement from the inside of the housing 146 to the outside of the housing 146 may be created through the spiral-shaped fluid flow groove 164*a*-2. Accordingly, foreign objects can be prevented from entering the housing 146 from the exterior thereof. For example, the fluid flow groove 164*a*-2 may be formed to have depth d1 at an upper end portion of the outer surface of the foreign material blocking member 164 being less than depth d2 at a lower end portion of the outer surface of the foreign material blocking member 164. In other words, the depth of the fluid flow groove 164*a*-2 may be formed to increase from the upper end portion to the lower end portion. Accordingly, the pressure at the upper end portion of the outer surface of the foreign material blocking member 164 may be greater than the pressure at the lower end portion of the outer surface of the foreign material blocking member 164. Consequently, in the foreign material blocking member 164, the fluid can flow from the upper end portion of greater pressure towards the lower end portion of lesser pressure due to the pressure difference. Meanwhile, width w1 at an upper end portion of the fluid flow groove 164*a*-2 is substantially identical to width w2 at a lower end portion of the fluid flow groove 164*a*-2.

Figure 7:
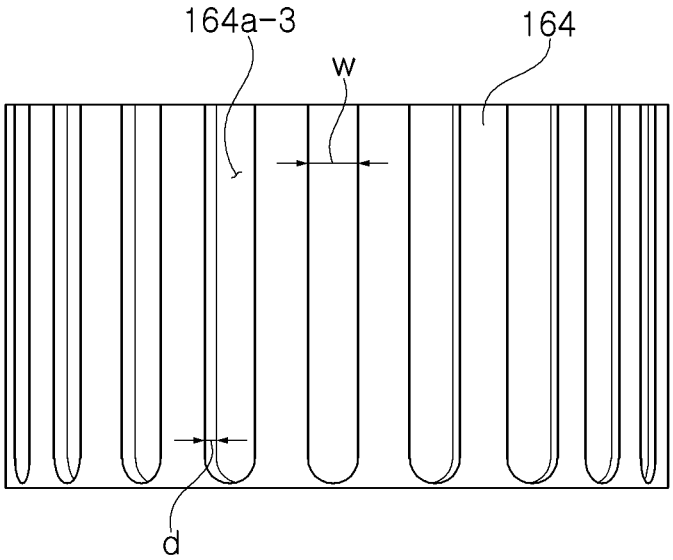
FIG. 7 illustrates an enlarged view of yet another example embodiment of a fluid flow groove.

FIG. 7 is an enlarged view of another example embodiments of the fluid flow groove 164*a*-3.

Referring to FIG. 7, a fluid flow groove 164*a*-3 may have a linear shape and may be formed in a direction parallel to the axial direction of the rotary shaft 162*a*. In other words, the fluid flow groove 164*a*-3 may be formed in an axial direction of the foreign material blocking member 164. Through the fluid flow groove 164*a*-3, provided in plurality and spaced apart from one another in a circumferential direction on the outer surface of the foreign material blocking member 164, a fluid movement from the inside of the housing 146 to the outside of the housing 146 may be created. Accordingly, foreign objects can be prevented from entering the housing 146 from the exterior thereof. For example, the fluid flow groove 164*a*-3 may be designed to have a predetermined width w and depth d. For example, the fluid flow groove 164*a*-3 may be formed to have an overall uniform width w and depth d.

Figure 8:
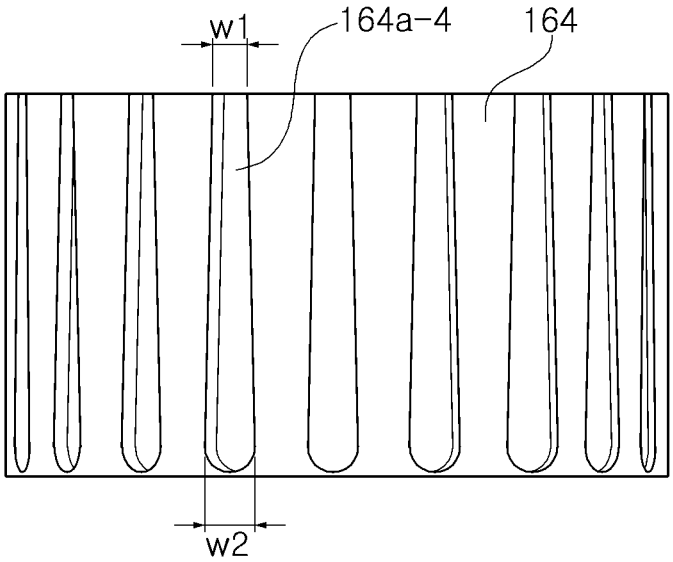
FIG. 8 illustrates an enlarged view of yet another example embodiment of a fluid flow groove.

FIG. 8 is an enlarged view of yet another example embodiments of the fluid flow groove 164*a*-4.

Referring to FIG. 8, a fluid flow groove 164*a*-4 may have a linear shape and may be formed in a direction parallel to the extending direction of the rotary shaft 162*a*. In other words, the fluid flow groove 164*a*-4 may be formed in an axial direction of the foreign material blocking member 164. Accordingly, through the fluid flow groove 164*a*-4, provided in plurality and spaced apart from one another in a circumferential direction on the outer surface of the foreign material blocking member 164, a fluid movement from the inside of the housing 146 to the outside of the housing 146 may be created. Accordingly, foreign objects can be prevented from entering the housing 146. For example, the fluid flow groove 164*a*-4 may be formed to have a width w1 at an upper end portion of the outer surface of the foreign material blocking member 164 being smaller than a width w2 at a lower end portion of the outer surface of the foreign material blocking member 164. In other words, the width of the fluid flow groove 164*a*-4 may be formed to increase from the upper end portion towards the lower end portion. Accordingly, the pressure at the upper end portion of the outer surface of the foreign material blocking member 164 may be greater than the pressure at the lower end portion of the outer surface of the foreign material blocking member 164. Consequently, in the foreign material blocking member 164, the fluid can flow from the upper end portion of greater pressure towards the lower end portion of lesser pressure.

Figure 9:
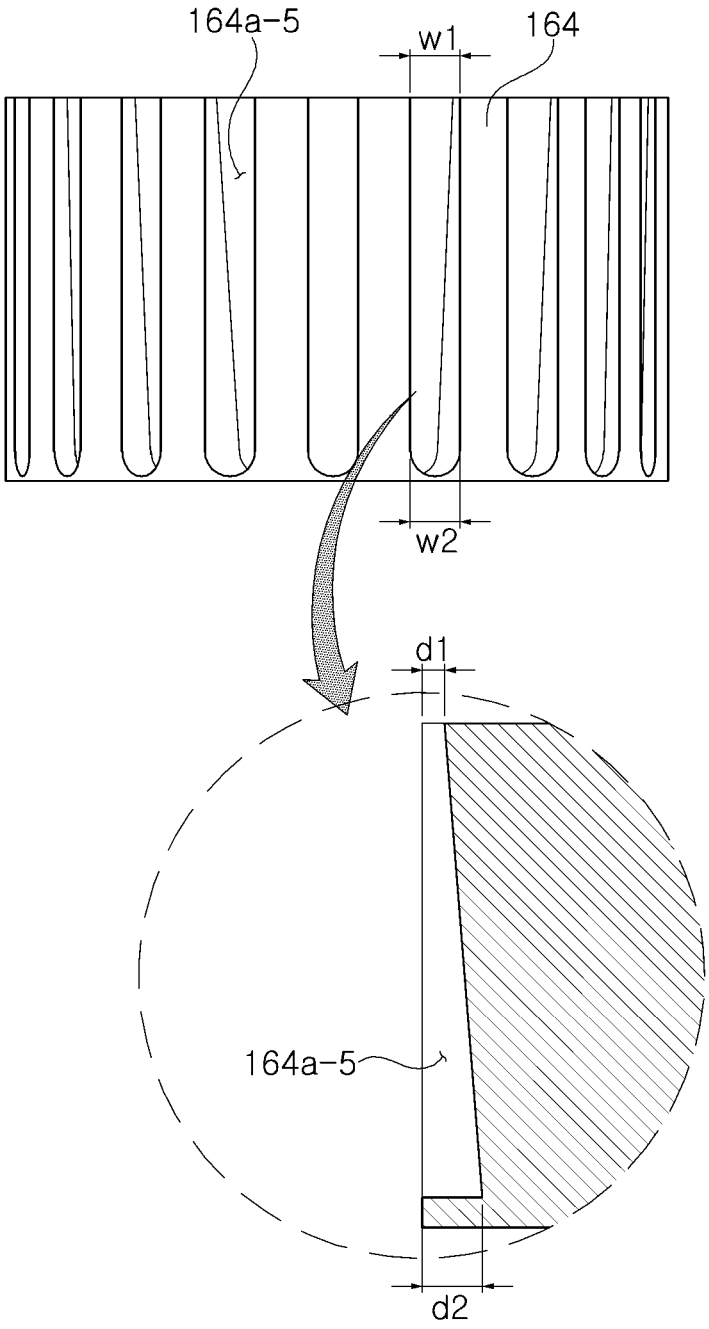
FIG. 9 illustrates an enlarged view of yet another example embodiment of a fluid flow groove.

FIG. 9 is an enlarged view of yet another example embodiments of the fluid flow groove 164*a*-5.

Referring to FIG. 9, a fluid flow groove 164*a*-5 may have a linear shape and may be formed in a direction parallel to the extending direction of the rotary shaft 162*a*. In other words, the fluid flow groove 164*a*-5 may be formed in an axial direction of the foreign material blocking member 164. Accordingly, through the fluid flow groove 164*a*-5, provided in plurality and spaced apart from one another in a circumferential direction on the outer surface of the foreign material blocking member 164, a fluid movement from the inside of the housing 146 to the outside of the housing 146 can be created. Accordingly, foreign objects can be prevented from entering the housing 146 from the exterior thereof. For example, the fluid flow groove 164*a*-5 may be formed to have depth d1 at an upper end portion of the outer surface of the foreign material blocking member 164 being less than depth d2 at a lower end portion of the outer surface of the foreign material blocking member 164. In other words, the depth of the fluid flow groove 164*a*-5 may be formed to increase from the upper end portion towards the lower end portion. Accordingly, the pressure at the upper end portion of the outer surface of the foreign material blocking member 164 may be greater than the pressure at the lower end portion of the outer surface of the foreign material blocking member 164. Consequently, in the foreign material blocking member 164, a fluid can flow from the upper end portion of greater pressure towards the lower end portion of lesser pressure.

According to example embodiments of the present inventive concept, there may be provided a polishing pad conditioning apparatus capable of preventing foreign objects from entering a housing of the apparatus and moving towards a rotary motor rotating a conditioning disk.

Furthermore, according to example embodiments of the present inventive concept, there may be provided a polishing pad conditioning apparatus capable of reducing uneven wear of a conditioning disk and reducing damage to a structure having the conditioning disk installed thereon.

While example embodiments have been shown and described above, it will be apparent to those skilled in the art that modifications and variations could be made without departing from the scope of the present inventive concept as defined by the appended claims.

What is claimed is:

1. A polishing pad conditioning apparatus, comprising:
an apparatus body;
a pivot arm provided on the apparatus body and comprising a housing having an internal space and provided at a distal end portion of the pivot arm; and
a head unit disposed at the distal end portion of the pivot arm,
wherein the head unit comprises:
a rotary motor provided in the internal space of the housing, the rotary motor comprising a rotary shaft;
a foreign material blocking member connected to the rotary shaft;
a disk holder connected to the rotary shaft; and
a conditioning disk coupled to the disk holder, and
wherein the foreign material blocking member includes a fluid flow groove configured to guide a movement of fluid for preventing foreign objects from entering the housing on an outer surface of the foreign material blocking member.

2. The polishing pad conditioning apparatus of claim 1, wherein the fluid flow groove has a spiral shape.

3. The polishing pad conditioning apparatus of claim 2, wherein a first width of the fluid flow groove at a first end portion of the outer surface of the foreign material blocking member is smaller than a second width of the fluid flow groove at a second end portion opposite to the first end portion of the outer surface in an axial direction of the foreign material blocking member.

4. The polishing pad conditioning apparatus of claim 2, wherein a first depth of the fluid flow groove at a first end portion of the outer surface of the foreign material blocking member is less than a second depth of the fluid flow groove at a second end portion opposite to the first end portion of the outer surface in an axial direction of of the foreign material blocking member.

5. The polishing pad conditioning apparatus of claim 1, wherein the fluid flow groove has a linear shape.

6. The polishing pad conditioning apparatus of claim 5, wherein the fluid flow groove extends in an axial direction and comprises a plurality of fluid flow grooves, and
wherein the plurality of fluid flow grooves are spaced apart from one another in a circumferential direction of the foreign material blocking member.

7. The polishing pad conditioning apparatus of claim 1, wherein the head unit further includes a deformation member disposed between the foreign material blocking member and the disk holder in an axial direction of the deformation member.

8. The polishing pad conditioning apparatus of claim 7, wherein the deformation member includes a deformation groove for permitting deformation of the deformation member in response to an external force being applied to an outer surface of the deformation member.

9. The polishing pad conditioning apparatus of claim 8, wherein the deformation groove comprises:
a first deformation groove extending in an axial direction of the deformation member, and
a second deformation groove extending from the first deformation groove.

10. The polishing pad conditioning apparatus of claim 9, wherein the first deformation groove extends perpendicularly from the second deformation groove.

11. The polishing pad conditioning apparatus of claim 10, wherein the deformation member comprises elastic material.

12. The polishing pad conditioning apparatus of claim 1, wherein the housing further includes a fluid flow path configured to guide fluid an area between an inner surface of the housing and the outer surface of the foreign material blocking member.

13. The polishing pad conditioning apparatus of claim 12, wherein the fluid being supplied through the fluid flow path comprises at least one of air, an inert gas, or water.

14. The polishing pad conditioning apparatus of claim 13, wherein the pivot arm further comprises a fluid flow tube provided in the pivot arm; and wherein the fluid flow path is connected to the fluid flow tube.

15. A polishing pad conditioning apparatus, comprising:

an apparatus body;

a pivot arm extending from the apparatus body and including a housing having an internal space and provided at a first end portion of the pivot arm; and a head unit disposed at the first end portion of the pivot arm, wherein the head unit comprises:

a rotary motor provided in the internal space of the housing and comprising a rotary shaft;

a deformation member connected to the rotary shaft of the rotary motor;

a disk holder connected at a first portion of the deformation member along an axial direction of the deformation member; and a conditioning disk coupled to the disk holder, and wherein the deformation member includes a deformation groove for reducing deformation stress induced by an external force to the conditioning disk wherein the deformation groove comprises:

a first deformation groove extending in an axial direction; and a second deformation groove extending perpendicularly from the first deformation groove, wherein the housing includes a fluid flow path configured to guide fluid to an area between an inner surface of the housing and an outer surface of a foreign material blocking member.

16. The polishing pad conditioning apparatus of claim 15, wherein the deformation member comprises elastic material.

17. The polishing pad conditioning apparatus of claim 15, wherein the pivot arm further comprises a fluid flow tube provided in the pivot arm; and wherein the fluid flow path is connected to the fluid flow tube of the pivot arm.

* * * * *